US007539400B2

(12) United States Patent
Yao

(10) Patent No.: US 7,539,400 B2
(45) Date of Patent: May 26, 2009

(54) ELECTRIC RADIATOR FILLED WITH OIL

(76) Inventor: Guoning Yao, c/o Singfun Electric Group Co., Ltd., Fuhai Develop District, Ningbo Cixi City (CN)

( * ) Notice: Subject to any disclaimer, the term of this patent is extended or adjusted under 35 U.S.C. 154(b) by 397 days.

(21) Appl. No.: 10/595,509

(22) PCT Filed: Dec. 13, 2004

(86) PCT No.: PCT/CN2004/001439

§ 371 (c)(1),
(2), (4) Date: Apr. 24, 2006

(87) PCT Pub. No.: WO2006/026897

PCT Pub. Date: Mar. 16, 2006

(65) Prior Publication Data

US 2007/0065123 A1 Mar. 22, 2007

(51) Int. Cl.
*F24F 1/14* (2006.01)
*F28F 27/00* (2006.01)

(52) U.S. Cl. ..... 392/375; 236/36

(58) Field of Classification Search ..... 392/375, 392/376, 377, 378; 165/49, 168; 236/36, 236/37, 38, 39, 40, 41, 42; 237/16, 17, 18
See application file for complete search history.

(56) References Cited

U.S. PATENT DOCUMENTS 3,916,151 A * 10/1975 Reix ..... 392/375
4,950,871 A * 8/1990 Pollak et al. ..... 392/375
6,169,851 B1 * 1/2001 Naughton et al. ..... 392/378

FOREIGN PATENT DOCUMENTS

| | | | |
|---|---|---|---|
| CN | 2536943Y | A | 2/2003 |
| CN | 2672541Y | A | 1/2005 |
| JP | 199911037486 | A | 2/1999 |
| JP | 199911311489 | A | 11/1999 |

OTHER PUBLICATIONS

International Search Report for PCT/CN2004/001439.

* cited by examiner

*Primary Examiner*—Daniel L Robinson
(74) *Attorney, Agent, or Firm*—Wood, Herron & Evans, LLP

(57) ABSTRACT

An improved electric radiator filled with oil includes a plurality of radiating fins, an electric-control box and a heater. Within the electric-control box, a switch, a temperature controller, a heat protector and a wire are provided. The radiating fin is hollow and sheet-like with at least two grooves therein for leading oil. The upper and lower ends of the fins are provided with hollow connecting-sleeves, oil-inflow holes are formed inside the connecting-sleeves. Each of the radiating fins is communicated with the oil-inflow hole and is filled with oil. Either the upper and the lower ends of each radiating fin are in different vertical planes, or the upper and the lower ends of each radiating fin are in a same vertical plane, but at least a part of the middle of each radiating fin is curved to form a convex configuration towards the side. Each of the radiating fins has the same shape and dimensions.

9 Claims, 6 Drawing Sheets

ELECTRIC RADIATOR FILLED WITH OIL

THE FIELD OF THE INVENTION

The present invention relates to an electric radiator, especially to an electric radiator filled with oil which uses the electric heating components to heat up the fluid medium such as mineral oil.

BACKGROUND OF THE INVENTION

Electric radiators filled with oil are more and more popular among the consumers with its advantages such as environment protection, cleanness and non-pollution. However, in the prior art, the radiating fins of all kinds of the electric radiators filled with oil are straight-lined. The straight lined fins, in spite of convenience for processing and assembly, still have the following disadvantages:

1. It makes against the pervasion of heat into the surrounding air because the heat emitted by the radiating fins will directly rise into the air so that the warming effect is not good enough.

2. It is hard to reasonably make spaces for the installation of the accessories such as the fan and humidifier. If these accessories were installed, on one hand, the whole product would be too large in bulk to cause inconvenience for transportation and use, and on the other hand, lead to waste of spaces.

3. The heat radiating effect is not good, while the quantity of the radiating fins is fixed, the maximum power of the electrothermal wires that can be installed would be restricted. Accordingly, the places this kind of electric radiator can be used are limited.

The Utility Model Patent CN2536943 authorized by the State Intellectual Property Office of P.R.C. on Feb. 19, 2003, disclosed a new type of electric radiator filled with oil, it includes a heat tube, a plurality of connecting sleeves and radiating fins and a controlling box, the connecting sleeves link the radiating fins and the controlling box, the heat tube immerges into the heat-conducting oil contained in the oil-filled radiating fins, wherein the radiating fin which adjacent to the controlling box is not filled with oil so it can help to insulate the heat to a certain extent, thus lowering the internal temperature of the controlling box and prolonging the lifespan of the electric radiator. Although this electric radiator filled with oil is more technically advanced than the existing technologies, it still has the above-mentioned disadvantages since its fins are straight-lined.

SUMMARY OF THE INVENTION

The purpose of present invention is to overcome the disadvantages of above-mentioned prior art, and to provide an improved electric radiator filled with oil, in which not only is the heat easy to radiate with a resulting good warming effect; but also the spaces of the whole product can be better utilized, the accessories such as the fan and humidifier can be installed without enlarging the bulk of the product too much. Furthermore, greater power electrothermal wires can be chosen while the quantity of the radiating fins is fixed due to good radiating effect, so it can be used in more places.

The improved electric radiator filled with oil according to the present invention comprises a plurality of radiating fins which are linked in turn, each of the radiating fins is hollow and sheet-like with at least two grooves therein for leading oil, the upper and lower ends of each radiating fin is formed or mounted with hollow connecting sleeves extended horizontally, and oil-inflow holes are formed inside the connecting sleeves; each of the radiating fins is communicated with the oil-inflow hole and is filled with oil; an electric-control box mounted on the radiating fins, in which a switch, a temperature controller, a heat protector and a wire are provided; a heater is located inside of the radiating fins; either the upper and lower ends of each radiating fin are in the different vertical planes, or the upper and lower ends of each radiating fin are in a same vertical plane, but at least a part of the middle of which is curved to form a convex configuration towards the side, each of the radiating fins has the same shape and dimension.

The improved electric radiator filled with oil according to the present invention still has following pertaining technical characteristics.

In a preferred embodiment of this invention, the upper and lower ends of each radiating fins are in the different vertical planes and are connected by a curved portion, the curved portion includes two folds which are reversed to each other in direction; the two folds, with equal radius and length of the arc, are circular-arc in shape, the radius R of which is not less than 15 mm and the central angle $\alpha$ of which ranges between 30° and 60°; the lengths of the upper end and the lower end of each radiating fin are equal, the ratio of this length to the height of the curve portion ranges between 1:1 and 5:1.

In another preferred embodiment of this invention, the upper and lower ends of each radiating fin are in a same vertical plane and are connected by a curved portion, the curved portion includes a middle fold and two end folds which are at two ends of the middle fold, the two end folds have the same direction which is reverse to the direction of the middle fold; both the middle fold and end folds are circular-arc in shape, the radius R1 of the middle fold ranges between 80 mm and 100 mm with the central angle ranging between 40° and 70°; the radius R2 of the end folds ranges between 15 mm and 30 mm with the central angle ranging from 30° to 50°; the length of the upper end and the lower end are equal, the ratio of this length to the height of the curved portion ranges between 1:1 to 0.2:1.

The electric-control box is installed on the leftmost radiating fin, a back cover is installed on the rightmost radiating fin, both the electric-control box and the back cover are provided with holes for radiating heat; wheels are installed at the bottom of the radiating fins.

The improved electric radiator filled with oil according to the present invention has the following advantages compared with the prior art: First, as each radiating fin has a curved structure in the longitudinal section direction, the heat can radiate along the curved portion with a better convection with the surrounding air, thus the environment temperature can be risen soon with a good warming effect; Correspondingly, compared with the straight lined fins in the prior art, the electrothermal wires with greater power can be chosen under the equal conditions, hence broaden the purposes and the places which can be used; Second, the hollow section formed by the curved structure makes space to install other accessories, with reasonable arrangement, the accessories such as the humidifier, the fan and the timer, etc. can be installed without expanding the bulk of the whole product too much, thus saving space and facilitating transportation and use.

BRIEF DESCRIPTION OF THE DRAWINGS

In below the present invention will be explained detailed accompanying preferred embodiments which are shown in attached drawings.

DETAILED DESCRIPTION OF PREFERED EMBODIMENTS

Figure 1:
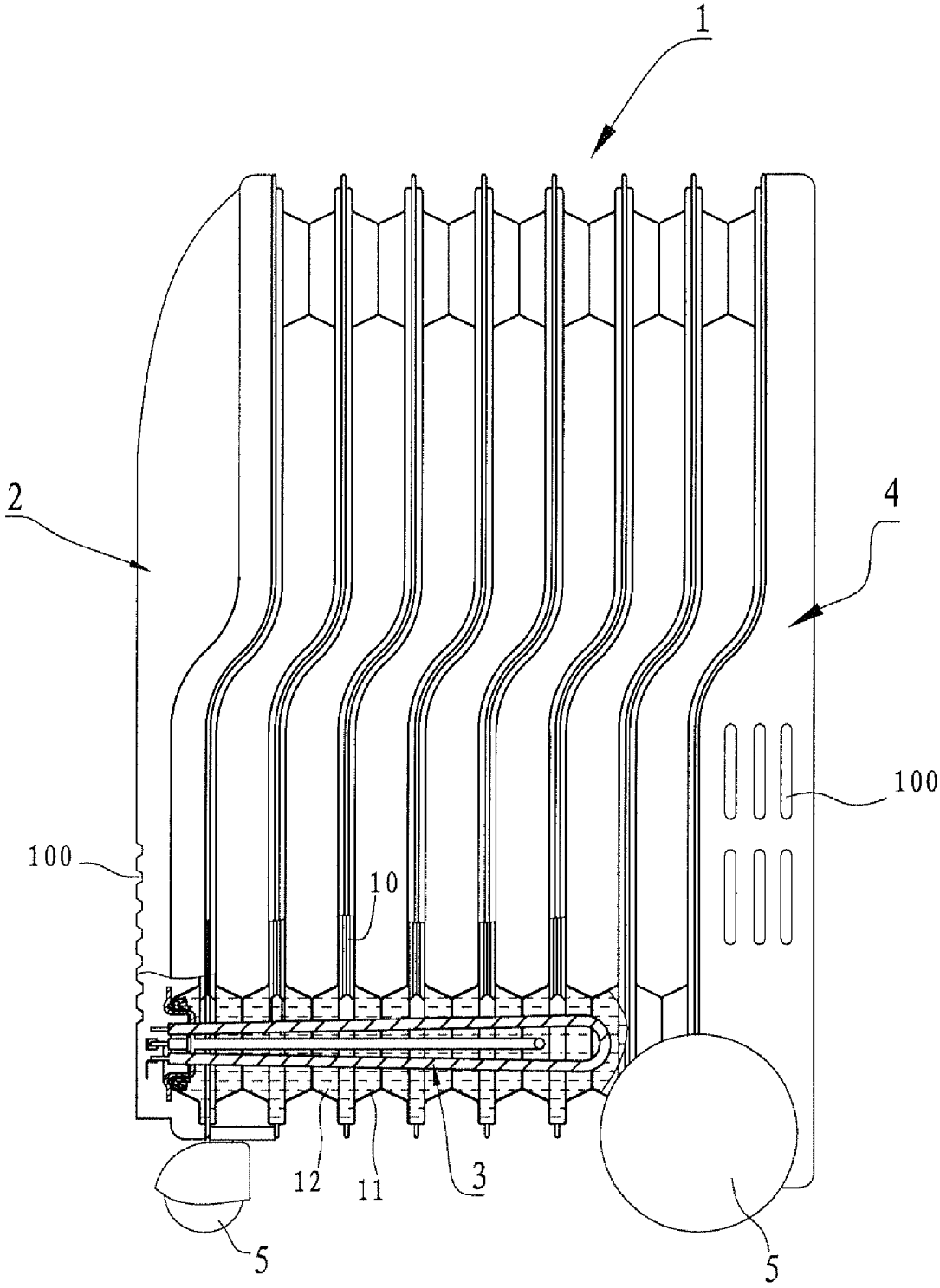
FIG. 1 a schematic diagram of the whole structure of the electric radiator filled with oil according to the present invention, in which the heater and the oil grooves are shown in partial section.

Referring to FIG. 1, the improved electric radiator filled with oil according to the present invention includes a plurality of radiating fins 1 which are linked in turn, a electric-control box 2 mounted on the radiating fins 1 and a heater 3 located in the inside of the fins 1. As shown in this FIG. 1, the heater 3 is an electric pipe, the electric-control box 2 is installed on the leftmost fin 1, while a back cover 4 is installed on the rightmost fin 1. Both the electric-control box 2 and the back cover 4 are provided with holes 100 for radiating heat, the heat produced by the fins 1 can go through the holes 100 at the two ends. As shown in FIG. 1, wheels 5 are installed at the bottom of the fins 1; the wheels 5 can be various structures and shapes, which make the electric radiator easy to transport and use.

Figure 2:
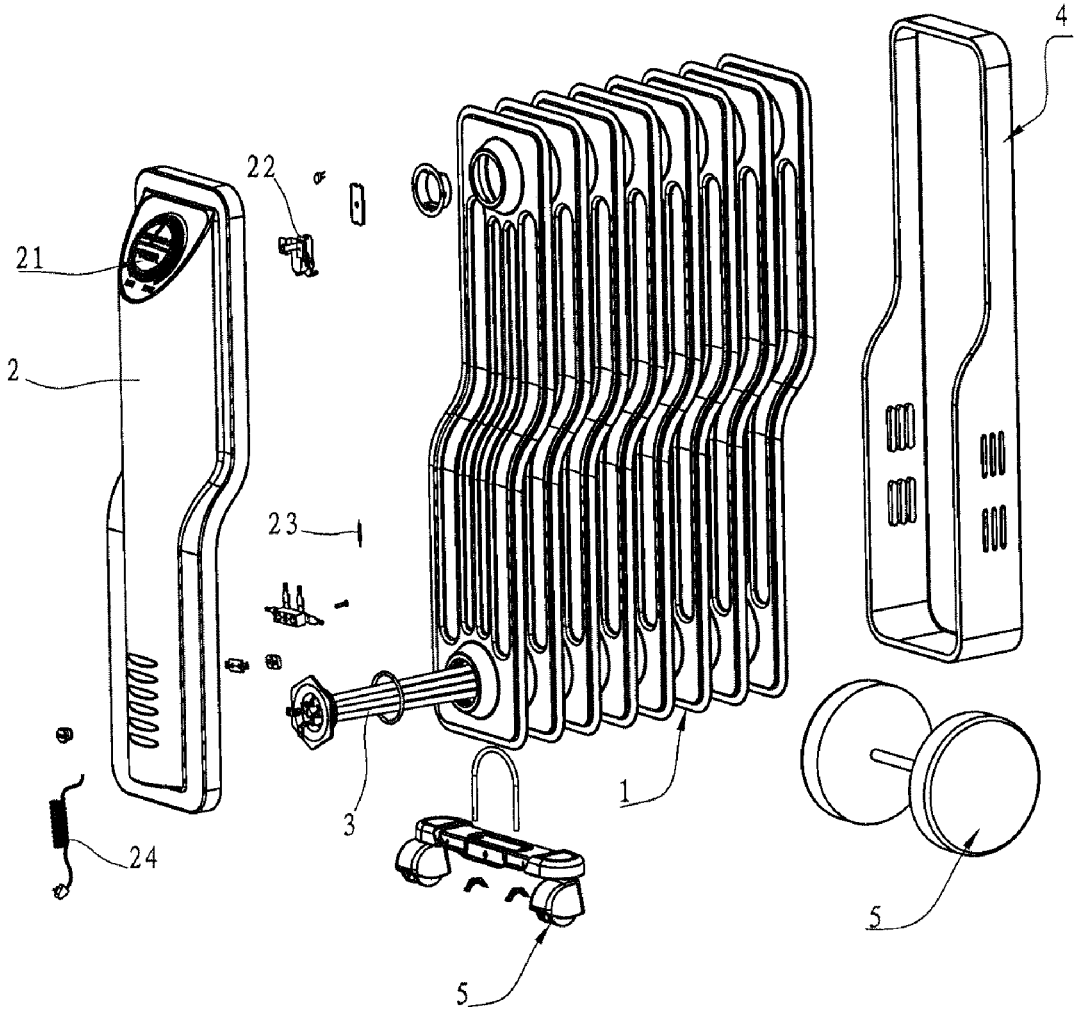
FIG. 2 is an exploded view of the electric radiator filled with oil as shown in FIG. 1, which shows the components of the electric radiator and the controlling members in the electric-control box.

As shown in FIG. 2, within the electric-control box 2, a switch 21, a temperature controller 22, a heat protector 23 and a wire 24 are provided; the wire 24 is used to connect the power, the switch 21 includes a power switch and a temperature-control knob, the temperature-control knob is used to adjust the working temperature of the electric radiator; the temperature controller 22 is used to keep the temperature of the fins invariably; the heat protector 23 can prevent the electric radiator from overheating; when the pre-set temperature is exceeded or it goes beyond normal work status, the heat protector 23 will automatically cut off the power. All these structures are conventional techniques and therefore are not described in detail here. Each of the radiating fins 1 is hollow and sheet-like with at least two grooves therein for leading oil, the upper and lower ends of each fin is formed or mounted with hollow connecting sleeves 11 extended horizontally, and oil-inflow holes are formed inside of the connecting sleeves 11; each of the radiating fins 1 communicates with the oil-inflow hole and is filled with oil. In the following preferred embodiments according to the present invention, the fin 1 and the connecting sleeve 11 are formed integrally. Each of the fins 1 is welded by two halves. The connecting sleeves 11 of each fin 1 are welded together to form the whole fins.

The present invention mainly improves the geometrical shape of the fins 1. In the electric radiator filled with oil according to the present invention, either the upper and lower ends of each fins 1 are in the different vertical planes, or the upper and lower ends of each fin 1 are in a same vertical plane, but at least a part of the middle of the fin 1 is curved to form a convex configuration towards the side. It means that the fin 1 has a curved structure in the longitudinal section direction. Each of the fins 1 has the same shape and dimension, which means that the direction and extent of the curve of each fin in the electric radiator are the same. As shown in FIG. 1, the middle and the upside of the fins are both bent rightwards with the same curve extent size. In this case, with good-looking shape of the whole electric radiator, the processing technics are simplified and production cost reduced.

Figure 3:
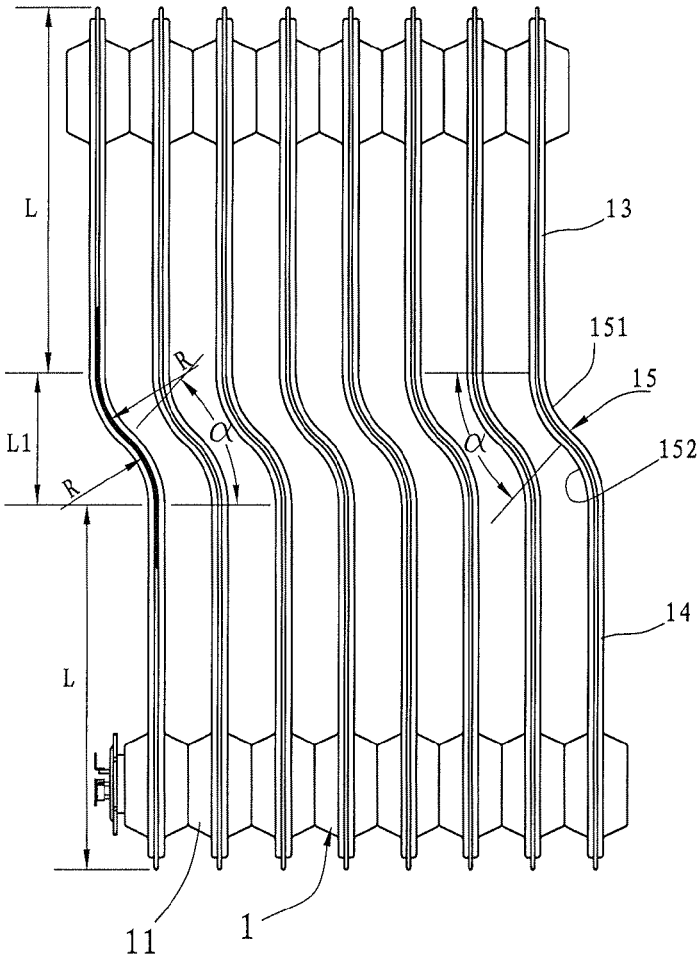
FIG. 3 is a front view of the radiating fins of the first preferred embodiment of the electric radiator filled with oil according to the present invention; the fin looks like an "S" in shape.
Figure 4:
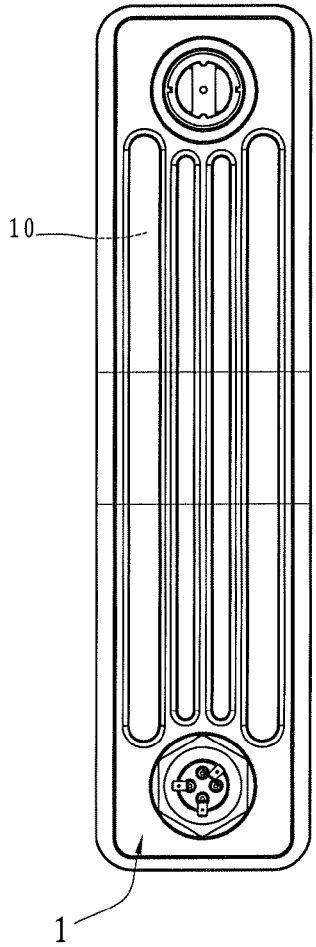
FIG. 4 is a left view of FIG. 3 showing the plane structure of the radiating fin and the distribution of oil grooves.
Figure 5:
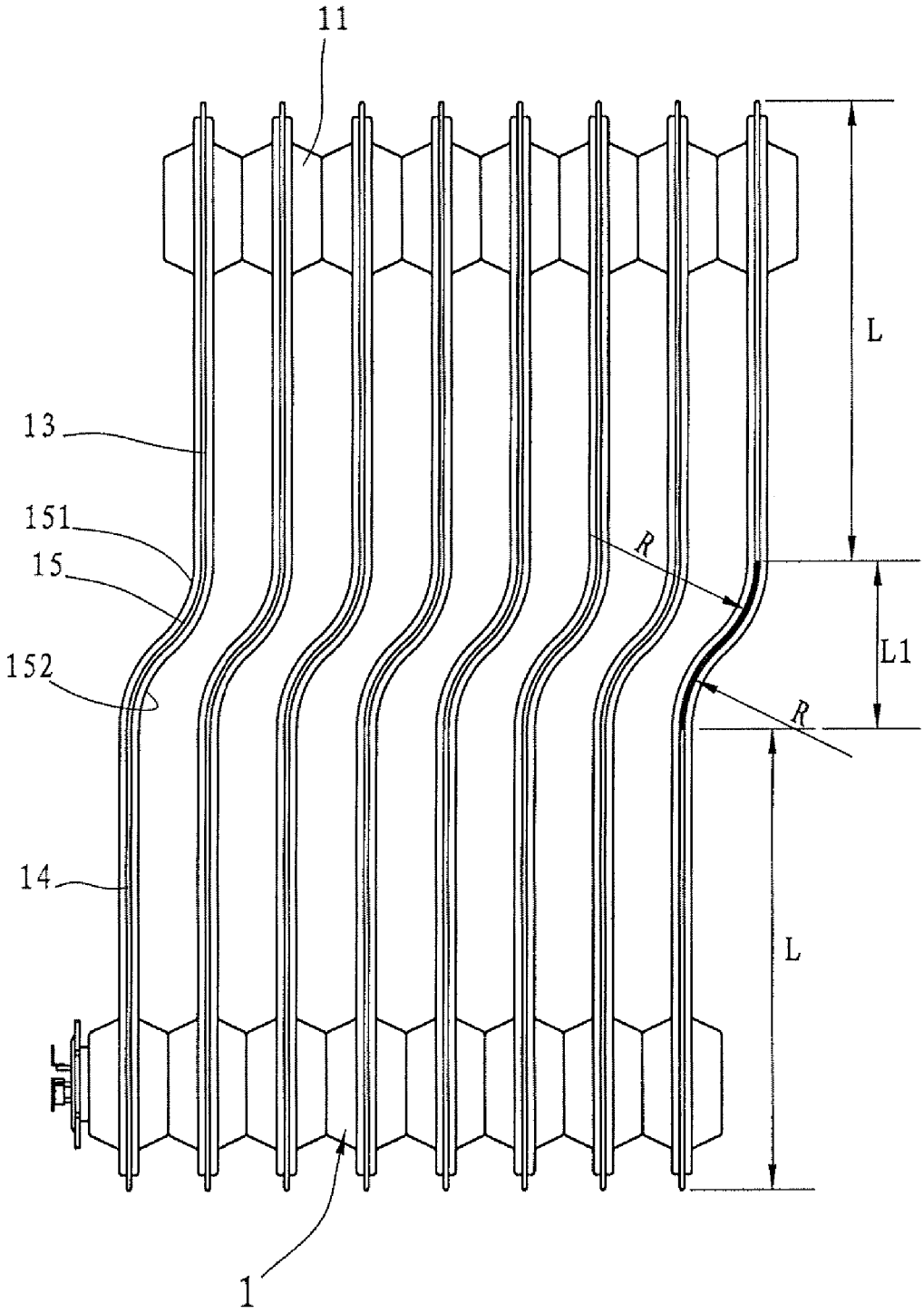
FIG. 5 is another pattern of the radiating fins shown in FIG. 3, the curved direction of the fins like a reversed "S", is opposite with the direction of the fins shown in FIG. 3.

As shown in FIG. 3 and FIG. 5, in a preferred embodiment according to the present invention, the upper end 13 and the lower end 14 of each of the fins 1 are on the different vertical planes, which are connected by the curved portion 15. The curved portion 15 includes two folds 151,152 which are reverse to each other in direction. Base on different bend directions of the folds, the fins 1 may take either of the two following structures: as shown in FIG. 3, the middle and the upside of the fins 1 are both bent leftwards with its longitudinal section being like an S-shape, the spaces formed in the bottom left and in the top right of the fins can be installed with some big accessories such as humidifier; in the structure shown in FIG. 5, the middle and the upside of the fins 1 are both bent rightwards with its longitudinal section being like a reversed "S" shape. The accessories with bigger bulk can be installed in the space formed in the top left and in the bottom right of the fins. Hence spaces of the product are well utilized.

In above-mentioned embodiments, both of the two folds 151,152 are circular-arc in shape with equal radius and length of arc, the radius R of the folds are not less than 15 mm with its central angle $\alpha$ ranging between 30° and 60°. The lengths of the upper end 13 and the lower end 14 of each fin 1 are equal as L, the ratio of L to L1, the height of the curve portion 15, is between 1:1 and 5:1. Fins which meet the above size range can be easily produced, furthermore the sufficient intensity and stiffness of the whole fin 1 can be ensured and without causing stress concentration, it also helps to ensure that the welding lines are well airproof as the fin is welded by two suited halves, thus preventing the leak of the liquid oil contained in oil grooves 10 of the fin 1. Note that: because the fin 1 has a certain thickness, R, the radius of the two folds 151, 152, refers to the radius at the middle line of the thickness plane of the fin (see FIG. 3 and FIG. 5). The length of the upper end 13 and the lower end 14 refers to the distance between the end (top or bottom) and the tangent points on the end folds 151, 152. In the preferred embodiments of this invention, R, the radius of two folds 151 is 20 mm with its central angle $\alpha$ is 48°. The ratio of L, the length of the upper end 13 and the lower end 14 of each fin 1, to L1, the height of the curve portion 15, is 3.5:1.

Figure 6:
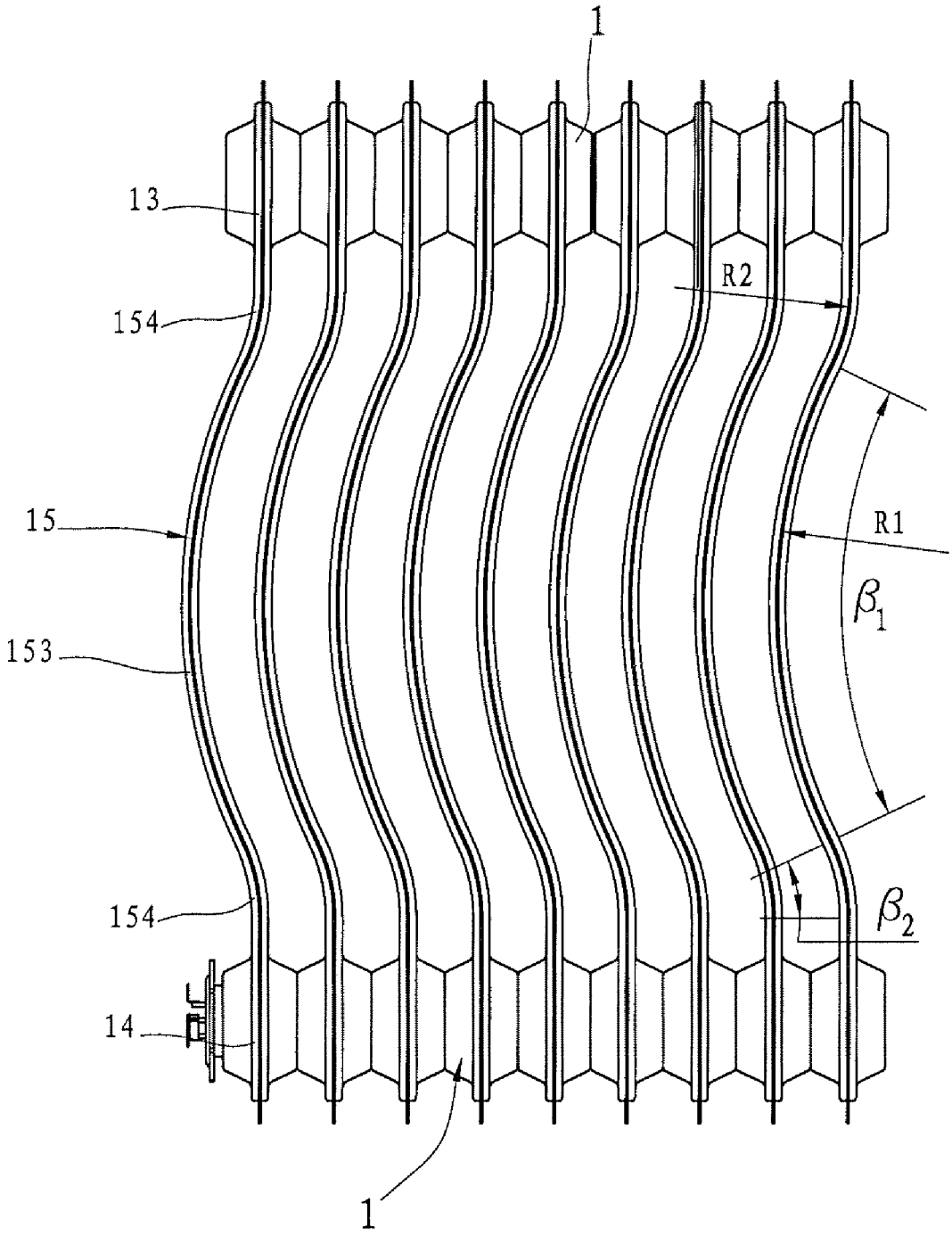
FIG. 6 is a front view of the radiating fins of the second preferred embodiment of the electric radiator filled with oil according to the present invention, the fin looks like a "C" in shape.
Figure 7:
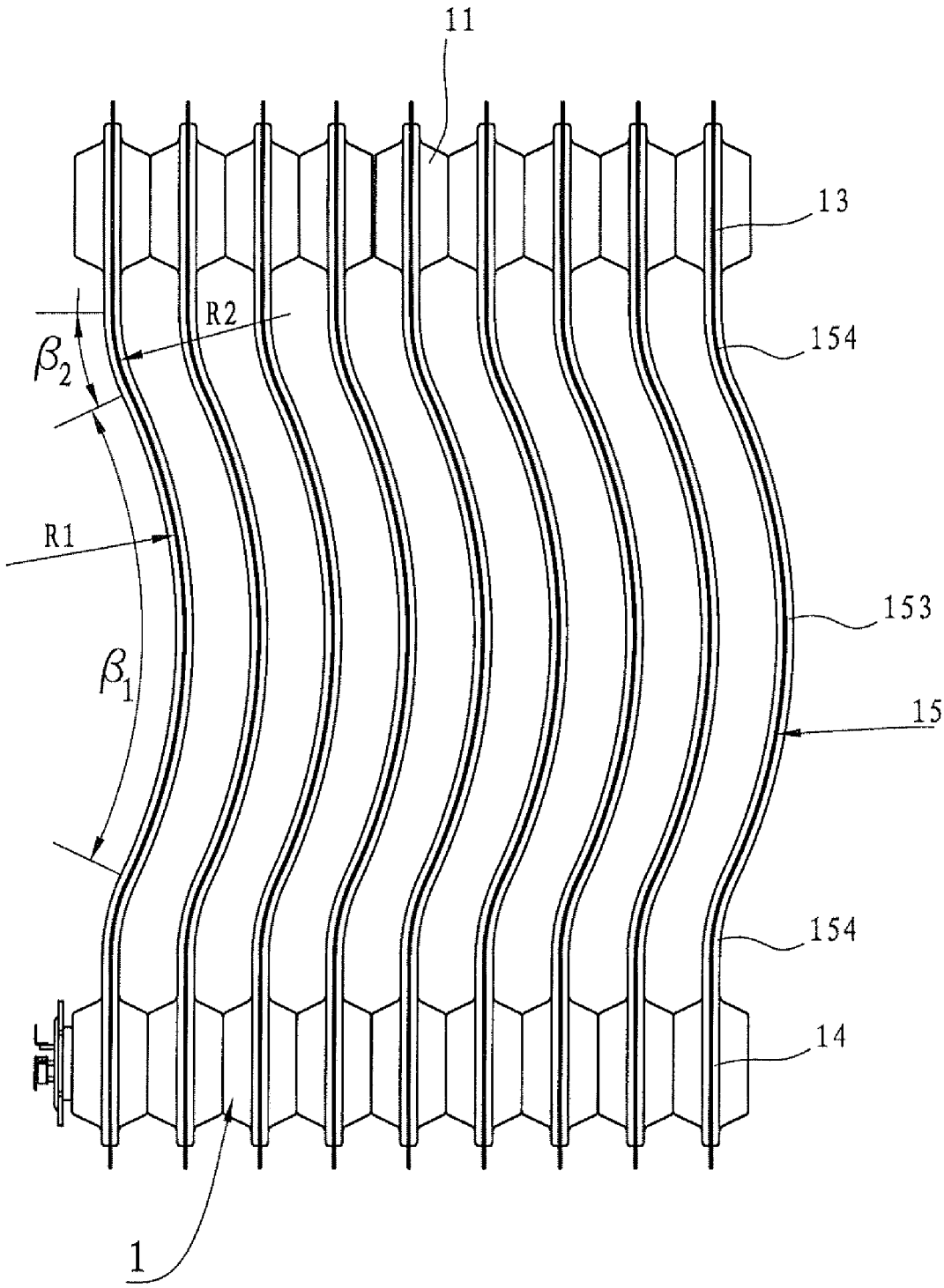
FIG. 7 is another pattern of the radiating fins shown in FIG. 6, the curved direction of the fins is opposite with the direction of the fins shown in FIG. 6.

As shown in FIG. 6 and FIG. 7, in another preferred embodiment according to the present invention, the upper end 13 and the lower end 14 are in a same vertical plane, which are connected by a curve portion 15. The curve portion 15 includes a middle fold 153 and two end folds 154 which are at the two ends of the middle fold 153. The two end folds 154 have the same direction which is reverse to the direction of middle fold 153. Base on different bend directions of the folds, the fin may take either of the two following structures: As shown in FIG. 6, the middle of the fins 1 are bent leftwards with its longitudinal section being like a C-shape. Therefore, space for installation of accessories such as humidifier is formed in the middle of the right of the fins; as shown in FIG. 7, the middle of the fins 1 are bent rightwards, therefore, space for installation of accessories such as humidifier is formed in the middle of the left of the fins. Hence the spaces are better utilized and the whole structure of the electric radiator becomes compact.

In the above-mentioned preferred embodiments, both the middle fold 153 and the end folds 154 are circular-arc in shape. R1, the radius of middle fold 153, is between 80 mm and 100 mm with the central angle $\beta_1$ ranging between 40° and 70°; R2, the radius of end folds 154, is between 15 mm and 30 mm with the central angle $\beta_1$ ranging between 30° and 50°. The lengths of the upper end 13 and the lower end 14 of each fin 1 are equal. The ratio of this length to the height of the curve portion 15 is between 1:1 and 0.2:1. Fins which meet the above size range can be easily produced, furthermore the sufficient intensity and stiffness of the whole fin 1 can be ensured and without causing stress concentration, it also helps to ensure that the welding lines are well airproof as the fin is welded by two suited halves, thus preventing the leak of the liquid oil contained in oil grooves 10 of the fin 1. As explained above, the radius of the middle fold 153 and the end folds 154, refers to the radius at the middle line of the thick plane of fin 1, the height of the upper end 13 and the lower end 14 refers to the distance between the end (top or bottom) and the tangent points on the end folds 154.

All of the above embodiments are used to explain the invention only, and not to limit the interpretation of this invention. It will be understood by those skilled in the art that various changes in form and details are possible without departing from the spirit and scope of the present invention, for example curve the fins to other shapes, hence all the equivalent schemes are in the scope of the present invention.

The invention claimed is:

1. An electric radiator adapted to be filled with oil and comprising:

a plurality of generally vertically extending radiating fins being linked in turn, each radiating fin being hollow and sheet-like and having at least two grooves therein for oil, hollow connecting sleeves extending generally horizontally from upper and lower ends of each fin, each connecting sleeve including an oil-inflow hole therein in communication with the fin such that the fins may be filled with oil;

an electric-control box mounted in relation to the radiating fins and having operatively associated therewith a switch, a temperature controller, a heat protector, and a wire;

a heater located inside of the radiating fins;

the plurality of fins being similarly shaped and dimensioned and with the upper end of each respective fin extending in a respective first vertical plane and the lower end of each respective fin extending in a respective second vertical plane, the plurality of fins being selected from the group of (a) a first set of fins wherein for each fin in the first set of fins the respective first and second vertical planes not being coplanar, or (b) a second set of fins wherein for each fin in the second set of fins the respective first and second vertical planes being generally coplanar so to be in generally a same vertical plane, with at least a middle portion of each fin being curved to form a convex configuration towards a side.

2. The electric radiator filled of claim 1, wherein the plurality of fins are the first set of fins, each fin having a curved portion connecting the upper and lower ends, the curved portion including two oppositely-directed folds.

3. The electric radiator of claim 2, the two folds being generally equal in radius (R) and length of arc, and being generally circular-arc in shape, the radius R being not less than 15 mm, the folds defining a central angle between 30° and 60° inclusive.

4. The electric radiator claim 2, wherein the upper and lower ends of each fin are of generally equal length, the length and height of the curved portion defining a ratio between 1:1 and 5:1 inclusive.

5. The electric radiator of claim 1 further comprising a back cover, the electric-control box being associated with a leftmost radiating fin, the back cover being associated with a rightmost radiating fin, and wherein the electric-control box and the back cover include heat radiating holes.

6. The electric radiator of claim 1 further comprising wheels mounted in relation to a bottom of the radiating fins.

7. An electric radiator adapted to be filled with oil and comprising:

a plurality of generally vertically extending radiating fins being linked in turn, each radiating fin being hollow and sheet-like and having at least two grooves therein for oil, hollow connecting sleeves extending generally horizontally from upper and lower ends of each fin, each connecting sleeve including an oil-inflow hole therein in communication with the fin such that the fins may be filled with oil;

an electric-control box mounted in relation to the radiating fins and having operatively associated therewith a switch, a temperature controller, a heat protector, and a wire;

a heater located inside of the radiating fins;

the plurality of fins being similarly shaped and dimensioned, and wherein the upper and lower ends of each fin are in generally a same vertical plane, with at least a middle portion of each fin being curved to form a convex configuration towards a side, and wherein the middle portion of each fin includes a middle fold in a first direction and two end folds at ends of the middle fold, the two end folds having a second direction which is reverse to the first direction.

8. The electric radiator of claim 7, the middle fold and end folds being circular-arc in shape, the middle fold having a radius between 80 mm and 100 mm inclusive and defining a central between 40° and 70° inclusive, each end fold having a respective radius between 15 mm and 30 mm inclusive and defining respective central angles between 30° and 50° inclusive.

9. The electric radiator of claim 7, wherein the upper and lower ends of each fin are of generally equal length, the length and height of the middle portion defining a ratio between 1:1 and 0.2:1 inclusive.

* * * * *

UNITED STATES PATENT AND TRADEMARK OFFICE

CERTIFICATE OF CORRECTION

PATENT NO. : 7,539,400 B2
APPLICATION NO. : 10/595509
DATED : May 26, 2009
INVENTOR(S) : Guoning Yao It is certified that error appears in the above-identified patent and that said Letters Patent is hereby corrected as shown below:

Claim 2

Column 6, line 4, "The electric radiator filled of" should be -- The electric radiator of --

Claim 4

Column 6, line 13, "The electric radiator claim" should be -- The electric radiator of claim --

Column 8

Column 6, line 51, "central between" should be -- central angle between --

Signed and Sealed this
Sixteenth Day of October, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,539,400 B2
APPLICATION NO. : 10/595509
DATED : May 26, 2009
INVENTOR(S) : Guoning Yao It is certified that error appears in the above-identified patent and that said Letters Patent is hereby corrected as shown below:

Claim 2

Column 6, line 4, "The electric radiator filled of" should be -- The electric radiator of --

Claim 4

Column 6, line 13, "The electric radiator claim" should be -- The electric radiator of claim --

Claim 8

Column 6, line 51, "central between" should be -- central angle between --

This certificate supersedes the Certificate of Correction issued October 16, 2012.

Signed and Sealed this
First Day of January, 2013

David J. Kappos

David J. Kappos
*Director of the United States Patent and Trademark Office*